US012144432B1

(12) United States Patent
Chen

(10) Patent No.: US 12,144,432 B1
(45) Date of Patent: Nov. 19, 2024

(54) ARMREST MECHANISM OF FOLDABLE SOFA

(71) Applicant: ANJI QIANYUAN FURNITURE CO., LTD., Huzhou (CN)

(72) Inventor: Feng Chen, Huzhou (CN)

(73) Assignee: ANJI QIANYUAN FURNITURE CO., LTD., Huzhou (CN)

( * ) Notice: Subject to any disclaimer, the term of this patent is extended or adjusted under 35 U.S.C. 154(b) by 0 days.

(21) Appl. No.: 18/798,066

(22) Filed: Aug. 8, 2024

(51) Int. Cl.

| | |
|---|---|
| ***A47C 17/04*** | (2006.01) |
| ***A47C 4/04*** | (2006.01) |
| ***A47C 4/52*** | (2006.01) |
| ***A47C 7/54*** | (2006.01) |
| *A47C 17/86* | (2006.01) |
| *A47C 19/12* | (2006.01) |

(52) U.S. Cl.
CPC ..... *A47C 7/543* (2013.01); *A47C 4/045* (2013.01); *A47C 4/52* (2013.01); *A47C 7/541* (2018.08); *A47C 17/04* (2013.01); *A47C 17/86* (2013.01); *A47C 19/124* (2013.01)

(58) Field of Classification Search
CPC ..... A47C 7/543; A47C 4/045; A47C 4/52; A47C 7/541; A47C 17/04; A47C 17/86; A47C 19/124
USPC ..... 297/35, 42, 411.3, 411.32, 411.37
See application file for complete search history.

(56) References Cited

U.S. PATENT DOCUMENTS

| | | | | |
|---|---|---|---|---|
| 11,406,192 | B1 * | 8/2022 | Wu | A47C 7/42 |
| 11,707,138 | B1 * | 7/2023 | Wu | A47C 7/546 5/12.1 |
| 2024/0081540 | A1 * | 3/2024 | Chen | A47C 17/04 |

FOREIGN PATENT DOCUMENTS

| | | | |
|---|---|---|---|
| CN | 218960376 U | * | 5/2023 |
| CN | 220512539 U | * | 2/2024 |

* cited by examiner

*Primary Examiner* — Robert Canfield
(74) *Attorney, Agent, or Firm* — Hemisphere Law, PLLC; Zhigang Ma

(57) ABSTRACT

An armrest mechanism of a foldable sofa includes an outer support plate, an inner bracing plate, and a driving rod. The outer support plate and the inner bracing plate are respectively arranged at two sides of the driving rod. Multiple groups of crank rod assemblies are arranged on the driving rod, and the driving rod is individually hinged with the outer support plate and the inner bracing plate through the crank rod assemblies. Each crank rod assembly includes a first rod and a second rod. An end of the first rod is hinged with the inner bracing plate and the other end is hinged with the driving rod. An end of the second rod is hinged with the outer support plate and the other end is hinged with the driving rod. A gear structure is engaged between the first rod and the second rod.

9 Claims, 5 Drawing Sheets

ARMREST MECHANISM OF FOLDABLE SOFA

TECHNICAL FIELD

The disclosure relates to the technical field of foldable sofas, and more particularly to an armrest mechanism of a foldable sofa.

BACKGROUND

With the rise of the Internet era, traditional furniture has also been sold through online channels. For example, large pieces of furniture such as sofas can also be delivered to thousands of households via logistics transportation.

An overall structure of the sofa is bulky, making logistics somewhat inconvenient. Although some folding structures exist in the related art to help reduce an occupied space of the sofa and facilitate transportation, most of armrest parts of these foldable sofa structures are mostly not foldable, which is not conducive to reducing the occupied space during transportation.

SUMMARY

The disclosure provides an armrest mechanism of a foldable sofa, aiming at solving the problem that most of armrest parts of current foldable sofa structures are mostly not foldable, which is not conducive to reducing an occupied space during a transportation process.

The disclosure is realized as follows. Specifically, an armrest mechanism of a foldable sofa includes an outer support plate, an inner bracing plate, a driving rod. The outer support plate and the inner bracing plate are respectively arranged at two sides of the driving rod. Multiple groups of crank rod assemblies are arranged on the driving rod, and the driving rod is individually hinged with the outer support plate and the inner bracing plate through the multiple groups of crank rod assemblies. Each crank rod assembly includes a first rod and a second rod. An end of the first rod is hinged with the inner bracing plate, and an end of the first rod facing away from the inner bracing plate is hinged with the driving rod. An end of the second rod is hinged with the outer support plate, an end of the second rod facing away from the outer support plate is hinged with the driving rod, and a gear structure is arranged between the first rod and the second rod for meshing connection.

In an embodiment, the first rod is provided with a front connecting end and a rear connecting end, the front connecting end is hinged with the driving rod, and the rear connecting end is hinged with the inner bracing plate.

In an embodiment, the first rod and the second rod have a same structure, and two ends of the second rod are respectively hinged on the driving rod and the outer support plate.

In an embodiment, a first gear ring is arranged at a front end of the front connecting end, a second gear ring with a same structure as the first gear ring is arranged on the second rod, and the first gear ring and the second gear ring are in meshing connection.

In an embodiment, the driving rod includes a first sliding section, a second sliding section, and a guide connecting section. The first sliding section and the second sliding section are respectively arranged at two ends of the guide connecting section.

In an embodiment, the first sliding section is located at an end of the driving rod facing away from the ground, the second sliding section is located at an end of the driving rod close to the ground, and a length of the first sliding section is less than that of the second sliding section.

In an embodiment, the number of groups of crank rod assemblies is two groups. The guide connecting section is provided with a second hinge hole group configured (i.e., structured and arranged) to connect one group of crank rod assemblies, and the first sliding section is provided with a first hinge hole group configured to connect the other group of crank rod assemblies.

In an embodiment, the first hinge hole group and the second hinge hole group have a same structure.

Compared with the related art, the embodiments of the disclosure mainly have the following beneficial effects.

The armrest mechanism of the foldable sofa provided by the disclosure realizes that the outer support plate and the inner bracing plate are far away from each other to form a rectangular support region through the cooperation of the driving rod and the crank rod assemblies, and serve as an inner frame of the armrest of the foldable sofa after deformation. During the transportation process, the outer support plate can be pushed to cause the driving rod to move, so that the outer support plate and the driving rod can be close to the inner bracing plate to form a folded state. By changing the state of the armrest mechanism of the foldable sofa, the shape change of the foldable sofa can be realized, so as to minimize the occupied space of the sofa during transportation.

DESCRIPTION OF REFERENCE SIGNS

100. outer support plate; 200, driving rod; 210. first sliding section; 220. second sliding section; 230. guide connecting section; 231. first hinge hole group; 232. second hinge hole group; 300. inner bracing plate; 400. crank rod assembly; 410. first rod; 411. front connecting end; 412. rear connecting end; 413. first gear ring; 420. second rod; 423. second gear ring; 430. gear structure; 500. foldable sofa.

DETAILED DESCRIPTION OF EMBODIMENTS

Unless otherwise defined, all technical and scientific terms used herein have the same meaning as commonly understood by those skilled in the art of the disclosure. Terminologies used in the specification of the disclosure herein are only for the purpose of describing specific embodiments and are not intended to limit the disclosure. The terms “including” and “having” in the specification and claims of the disclosure and the description of the above drawings, as well as any variations thereof, are intended to cover non-exclusive inclusion. The terms "first" and "second" in the specification and claims of the disclosure or the above drawings are used to distinguish different objects, not to describe a specific order.

The term "embodiment" herein refers to the fact that specific features, structures, or characteristics described in conjunction with the embodiment may be included in at least one embodiment of the disclosure. The appearance of this term in various places in the specification does not necessarily refer to the same embodiment, nor is it an independent or alternative embodiment mutually exclusive with other embodiments. It is understood explicitly and implicitly by those skilled in the art that the embodiments described herein can be combined with other embodiments.

Figure 1:
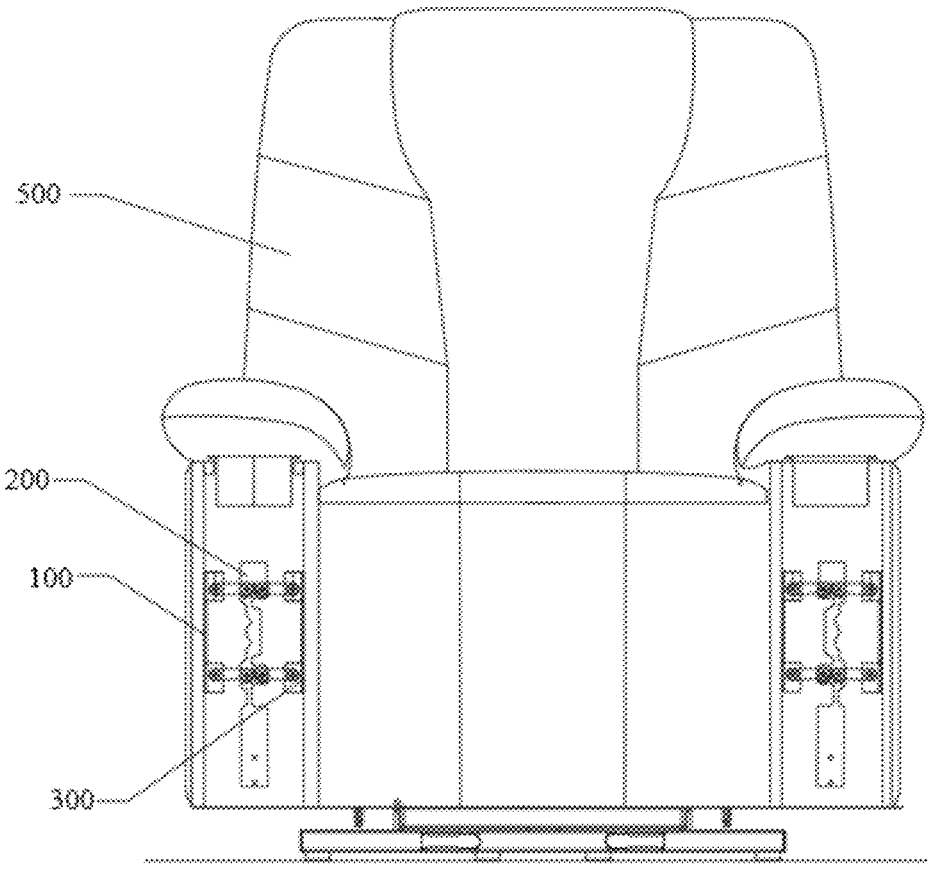
FIG. 1 illustrates a schematic structural view of an armrest mechanism of a foldable sofa provided by the disclosure.
Figure 2:
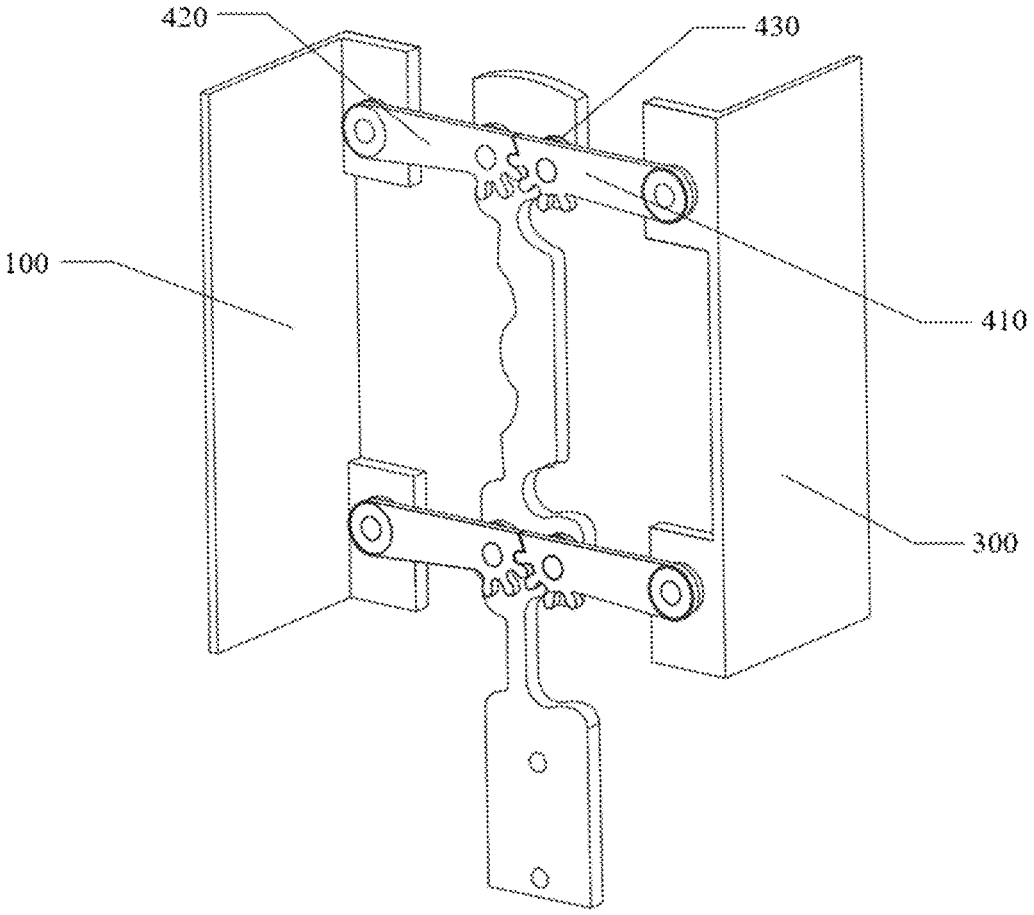
FIG. 2 illustrates a schematic structural view of the armrest mechanism provided by the disclosure.
Figure 3:
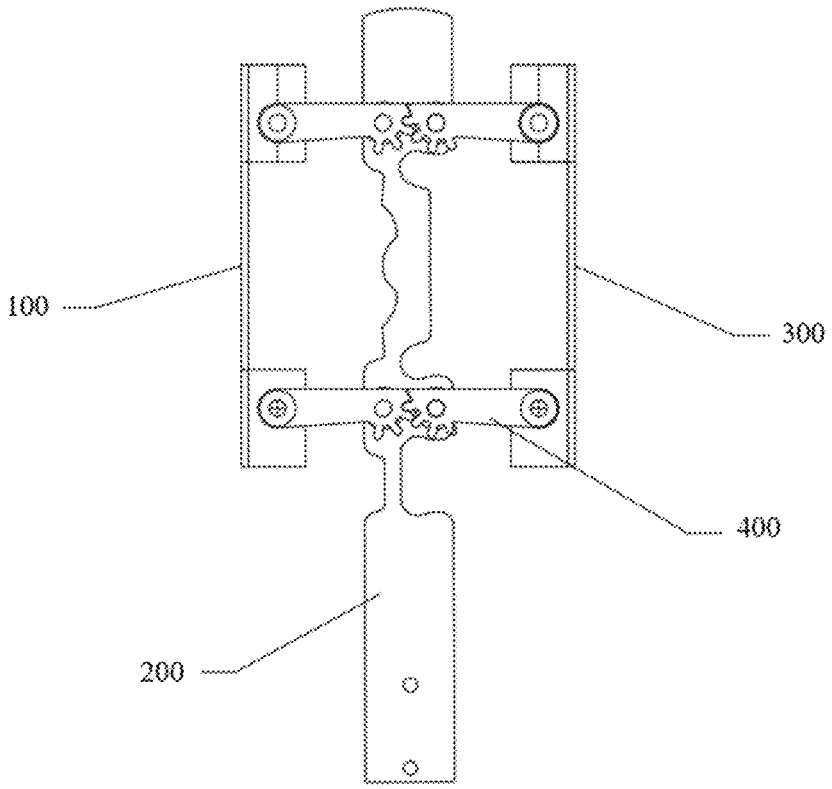
FIG. 3 illustrates a schematic structural view of the armrest mechanism in an unfolding state provided by the disclosure.
Figure 4:
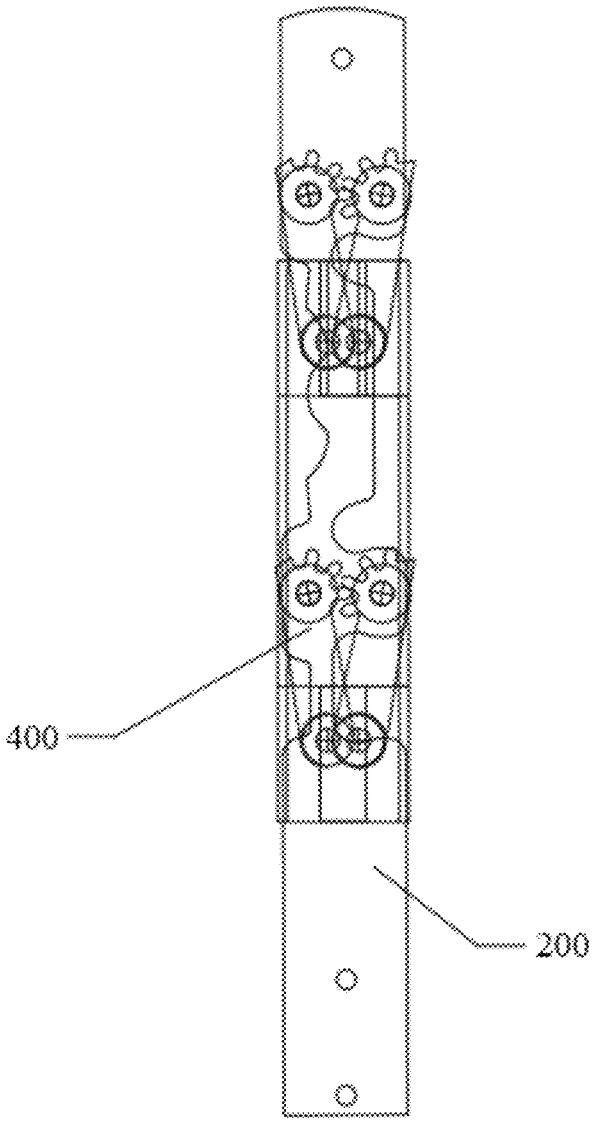
FIG. 4 illustrates a schematic structural view of the armrest mechanism in a folded state provided by the disclosure.
Figure 5:
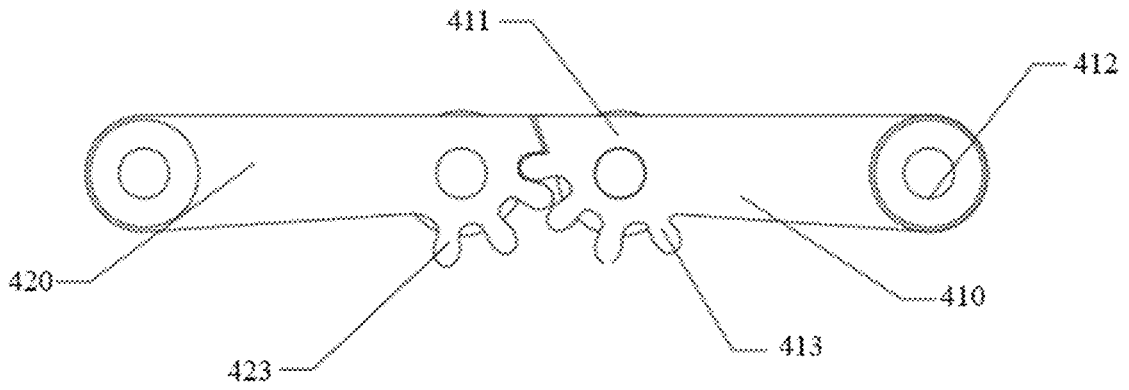
FIG. 5 illustrates a schematic structural view of crank rod assemblies of the armrest mechanism of the foldable sofa provided by the disclosure.
Figure 6:
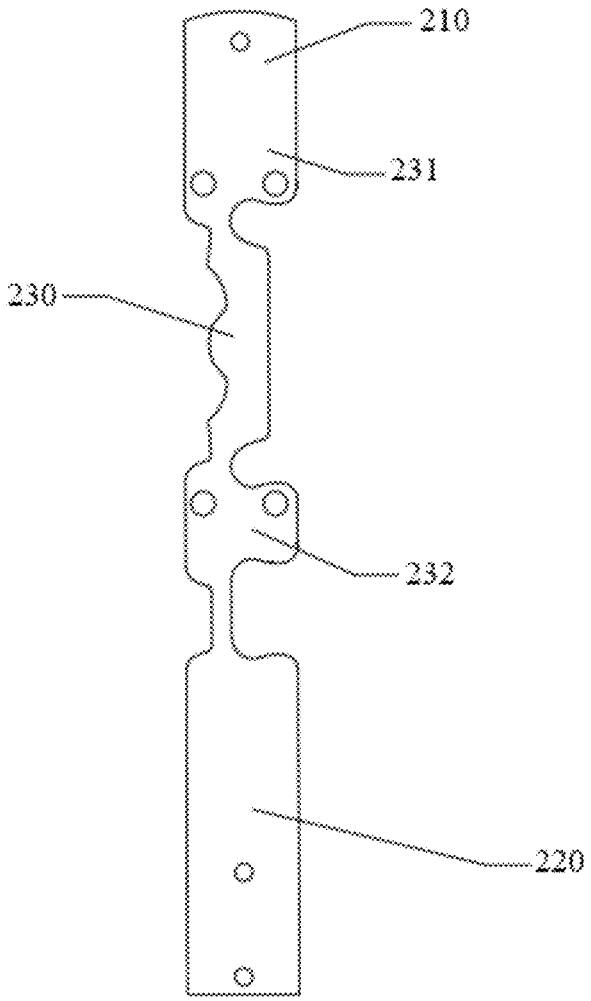
FIG. 6 illustrates a schematic structural view of a driving rod of the armrest mechanism of the foldable sofa provided by the disclosure.

An embodiment of the disclosure provides an armrest mechanism of a foldable sofa, as shown in FIG. 1 to FIG. 6, which includes: an outer support plate 100, an inner bracing plate 300, and a driving rod 200.

The driving rod 200 includes a first sliding section 210, a second sliding section 220 and a guiding connecting section 230. The outer support plate 100 and the inner bracing plate 300 are respectively arranged at two sides of the driving rod 200.

Crank rod assemblies 400 are arranged on the driving rod 200, and two ends of each crank rod assembly 400 are respectively hinged with the outer support plate 100 and the inner bracing plate 300.

The crank rod assembly 400 includes a first rod 410 and a second rod 420. An end of the first rod 410 is hinged with the inner bracing plate 300, and an end of the first rod 410 facing away from the inner bracing plate 300 is hinged with the driving rod 200. An end of the second rod 420 is hinged with the outer support plate 100, and an end of the second rod 420 facing away from the outer support plate 100 is hinged with the driving rod 200.

A gear structure 430 is engaged between the first rod 410 and the second rod 420. When the driving rod 200 moves vertically, the first rod 410 and the second rod 420 deflect synchronously with the help of the gear structure 430.

In this disclosure, the armrest mechanism of the foldable sofa is applied to an armrest part of the foldable sofa 500, and the armrest part of the foldable sofa 500 has a soft structure and can be deformed. In a normal state, the outer support plate 100 and the inner bracing plate 300 realize that the outer support plate 100 and the inner bracing plate 300 are far away from each other to form a rectangular support region through the cooperation of the driving rod 200 and the crank rod assemblies 400, and serve as an inner frame of the armrest of the foldable sofa 500 after deformation. During the transportation process, the outer support plate 100 can be pushed to cause the driving rod 200 to move, so that the outer support plate 100 and the driving rod 200 can approach the inner bracing plate 300 to form a folded state.

In the disclosure, the inner bracing plate 300 is directly connected to a seat of the foldable sofa 500, and both the outer support plate 100 and the driving rod 200 are designed to be suspended. Therefore, in an unfolded state (also referred to as an extended state), when the outer support plate 100 is subjected to compression, the driving rod 200 will move away from a ground direction under an action of gear deflection, causing the outer support plate 100 to move closer to a side of the inner bracing plate 300 to thereby complete the conversion from the unfolded state to the folded state.

As an illustrated embodiment of the disclosure, the first rod 410 of the crank rod assembly 400 is hinged between the driving rod 200 and the inner bracing plate 300, and the second rod 420 of the crank rod assembly 400 is hinged between the outer support plate 100 and the driving rod 200. The gear structure 430 is arranged between the first rod 410 and the second rod 420 to realize meshing connection, which provides a linkage limiting function for the first rod 410 and the second rod 420. When the driving rod 200 does not move, the crank rod assembly 400 cannot be deformed.

In this embodiment, the structures of the first rod 410 and the second rod 420 are the same. Here, taking the first rod 410 as an example, the first rod 410 is respectively provided with a front connecting end 411 and a rear connecting end 412. The front connecting end 411 and the rear connecting end 412 are mainly connected to the driving rod 200 and the inner bracing plate 300 by hinge means. The front connecting end 411 is provided with a first gear ring 413, and the second rod 420 is also provided with a second gear ring 423 with the same structure, and the front connecting end 411 is meshed with the second gear ring 423 on the second rod 420 through the first gear ring 413 to realize the transmission between the first rod 410 and the second rod 420.

As an illustrated embodiment of the disclosure, the guide connecting section 230 is provided with a second hinge hole group 232 configured to connect a group of crank rod assemblies 400, and the first sliding section 210 is provided with a first hinge hole group 231 configured to connect the other group of crank rod assemblies 400.

The first hinge hole group 231 and the second hinge hole group 232 have the same structure, and are mainly composed of two groups of through holes with the same aperture, which are used as hinge connection points of the crank rod assemblies 400.

In the disclosure, the first rod 410 and the second rod 420 are hinged with the outer support plate 100, the inner bracing plate 300 and the driving rod 200 in such a way that damping rings are placed on the outside of hinge axes. The damping rings are the existing structures, which mainly increase the rotating friction of the first rod 410 and the second rod 420 with the outer support plate 100, the inner bracing plate 300 and the driving rod 200, so as to avoid the sofa from being easily deformed.

Generally speaking, after the deformation is completed, the driving rod 200 will not easily rise under the action of gravity, so it will remain in the unfolded state, and it will not be easily deformed and unfolded when it is subjected to compression by surrounding components during transportation.

It should be noted that for the sake of simple description, all the aforementioned embodiments are expressed as a series of action combinations, but those skilled in the art should know that this disclosure is not limited by the described action sequence, because some steps may be performed in other sequences or simultaneously according to the disclosure. In addition, those skilled in the art should also know that the embodiments described in the specification are all illustrated embodiments, and the actions and modules involved are not necessarily necessary for the disclosure.

The above embodiments are only used to illustrate the technical solutions of the disclosure, and do not limit the protection scope of the disclosure. Apparently, the described embodiments are only some of the embodiments of the disclosure, not the whole embodiments. Based on these embodiments, all other embodiments obtained by those skilled in the art without creative work belong to the scope to be protected by the disclosure. Although the disclosure has been described in detail with reference to the above-mentioned embodiments, those skilled in the art can still combine, add, delete or make other adjustments to the features in various embodiments of the disclosure according to the situation without any conflict, so as to obtain different technical solutions that are not divorced from the concept of the disclosure, and these technical solutions also belong to the scope of protection of the disclosure.

What is claimed is:

1. An armrest mechanism of a foldable sofa, comprising:

an outer support plate (100), an inner bracing plate (300); and a driving rod (200), wherein the outer support plate (100) and the inner bracing plate (300) are respectively arranged at two sides of the driving rod (200); a plurality of groups of crank rod assemblies (400) are provided on the driving rod (200), and the driving rod (200) is individually hinged with the outer support plate (100) and the inner bracing plate (300) through the plurality of groups of crank rod assemblies (400); and wherein each of the plurality of groups of crank rod assemblies (400) comprises a first rod (410) and a second rod (420); an end of the first rod (410) is hinged with the inner bracing plate (300), and an end of the first rod (410) facing away from the inner bracing plate (300) is hinged with the driving rod (200); an end of the second rod (420) is hinged with the outer support plate (100), and an end of the second rod (420) facing away from the outer support plate (100) is hinged with the driving rod (200); and a gear structure (430) is arranged between the first rod (410) and the second rod (420) for meshing connection.

2. The armrest mechanism of the foldable sofa as claimed in claim 1, wherein the first rod (410) is provided with a front connecting end (411) and a rear connecting end (412), the front connecting end (411) is hinged with the driving rod (200), and the rear connecting end (412) is connected to the inner bracing plate (300).

3. The armrest mechanism of the foldable sofa as claimed in claim 2, wherein the first rod (410) and the second rod (420) have a same structure, and two ends of the second rod (420) are respectively hinged on the driving rod (200) and the outer support plate (100).

4. The armrest mechanism of the foldable sofa as claimed in claim 3, wherein a first gear ring (413) is arranged at a front end of the front connecting end (411), a second gear ring (423) with a same structure as the first gear ring (413) is arranged on the second rod (420), and the first gear ring (413) and the second gear ring (423) are in meshing connection.

5. The armrest mechanism of the foldable sofa as claimed in claim 4, wherein the driving rod (200) comprises a first sliding section (210), a second sliding section (220) and a guide connecting section (230); and the first sliding section (210) and the second sliding section (220) are respectively arranged on two ends of the guide connecting section (230).

6. The armrest mechanism of the foldable sofa as claimed in claim 5, wherein the first sliding section (210) is located at an end of the driving rod (200) facing away from ground, and the second sliding section (220) is located at an end of the driving rod (200) close to the ground.

7. The armrest mechanism of the foldable sofa as claimed in claim 6, wherein a length of the first sliding section (210) is less than that of the second sliding section (220).

8. The armrest mechanism of the foldable sofa as claimed in claim 5, wherein a number of the plurality of groups of crank rod assemblies (400) is two groups; and the guide connecting section (230) is provided with a second hinge hole group (232) configured to connect one group of crank rod assemblies (400), and the first sliding section (210) is provided with a first hinge hole group (231) configured to connect the other group of crank rod assemblies (400).

9. The armrest mechanism of the foldable sofa as claimed in claim 8, wherein the first hinge hole group (231) and the second hinge hole group (232) have a same structure.

* * * * *